US006405698B1

(12) United States Patent
Steinmetz

(10) Patent No.: US 6,405,698 B1
(45) Date of Patent: Jun. 18, 2002

(54) ROLLER TAPPET

(75) Inventor: Christoph Steinmetz, Ludwigsburg (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 09/857,919

(22) PCT Filed: Nov. 30, 1999

(86) PCT No.: PCT/EP99/09306

§ 371 (c)(1),
(2), (4) Date: Jun. 12, 2001

(87) PCT Pub. No.: WO00/36282

PCT Pub. Date: Jun. 22, 2000

(30) Foreign Application Priority Data

Dec. 12, 1998 (DE) ..... 198 57 376

(51) Int. Cl.[7] ..... F01L 1/14
(52) U.S. Cl. ..... 123/90.48; 74/569

(58) Field of Search ..... 123/90.48, 90.1, 123/90.5; 74/569

(56) References Cited

U.S. PATENT DOCUMENTS 5,385,124 A * 1/1995 Hillenbrand et al. ..... 123/90.5

FOREIGN PATENT DOCUMENTS

| | | |
|---|---|---|
| DE | 36 18 240 | 12/1987 |
| DE | 42 25 363 | 2/1994 |
| DE | 195 27 720 | 2/1997 |

* cited by examiner

*Primary Examiner*—Thomas Denion
*Assistant Examiner*—Sean D. O'Brien
(74) *Attorney, Agent, or Firm*—Collard & Roe, P.C.

(57) ABSTRACT

The invention relates to a roller tappet comprising an axle which supports the roller. The aim of the invention is to secure said roller in a simple manner in the roller bearings. To this end, the base body of the tappet is provided with a surrounding groove at pin level. A locking ring similar to a piston ring is arranged in the groove.

2 Claims, 1 Drawing Sheet

ROLLER TAPPET

CROSS REFERENCE TO RELATED APPLICATIONS

Applicants claim priority under 35 U.S.C. §119 of German Application No. 198 57 376.6, filed on Dec. 12, 1998. Applicants also claim priority under 35 U.S.C. §120 of PCT/EP99/09306, filed on Nov. 30, 1999. The international application under PCT article 21(2) was not published in English.

The invention relates to a roller tappet as defined in the introductory part of claim 1.

Such roller tappets are known, for example from U.S. Pat. No. 5,385,125 A. The axle of the roller is secured according to said patent via locking rings that are located within the bosses of the axle.

Said solution has a number of drawbacks: the supporting length of the roller axle is limited by the locking rings and the bearing is consequently subjected to higher stresses. Furthermore, cutting grooves in drilled holes requires substantial higher expenditure as compared to grooves located on the outside diameter.

The invention, therefore, is dealing with the problem of securing in conjunction with roller tappets of the type specified above the axle supporting the roller in a simple manner in the bosses of the hubs.

Said problem is solved in conjunction with roller tappets of the type specified above by the characterizing features of claim 1.Advantageous advanced developments of the invention are the object of the dependent claims.

It is entirely possible in this connection that the basic body of the tappet comprises one or a plurality of components that are connected with one another.

In conjunction with the solution as defined by the invention, the flanks of the locking ring no longer act as the surfaces on which the axle of the roller is running up, but said function is rather assumed now by the areas of the locking ring that are disposed radially inwards.

By virtue of the way in which the axle of the roller is secured as defined by the invention, with the help of locking rings that are disposed in grooves produced on the outside diameter of the roller tappet, machining costs are saved and only one locking ring is required, though one with a larger size. Another advantage has to be seen in the fact that only one groove needs to be cut.

The locking ring as defined by the invention does not have to be located in a plane containing the longitudinal axis of the roller axle, viewed in the axial direction of the tappet, but it may be located above or below said plane as well. It suffices if the roller axle, when displaced in the roller boss, runs up against the locking ring from the inside. Due to the out-of-center position of the locking ring, it is possible to increase the length of the roller axle and thus the supporting length even more as well.

Figure 1:
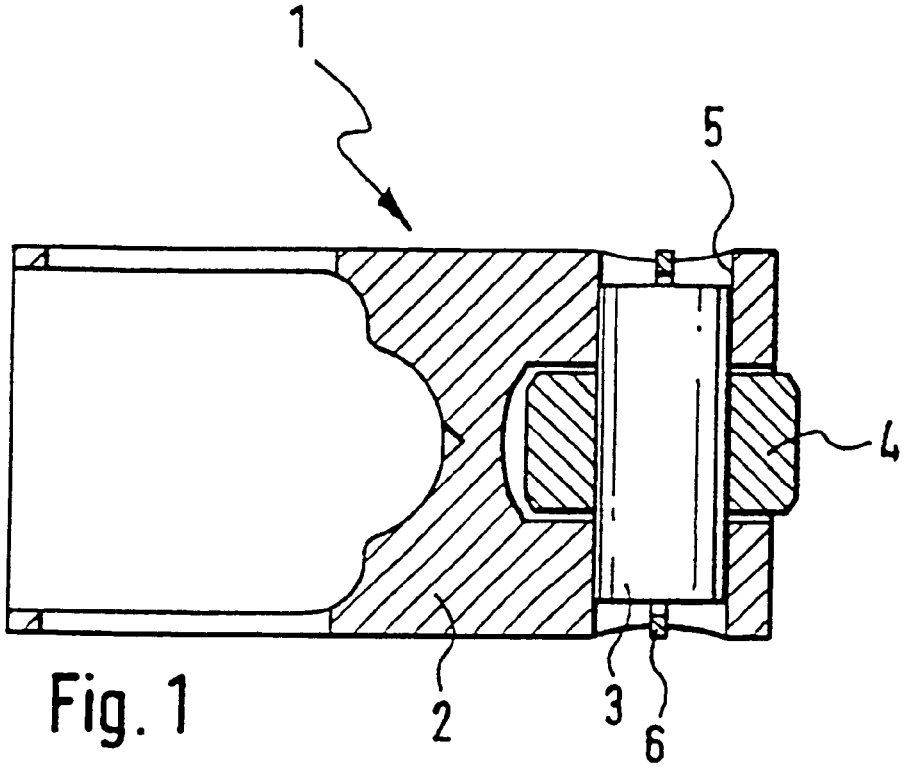
Figure 2:
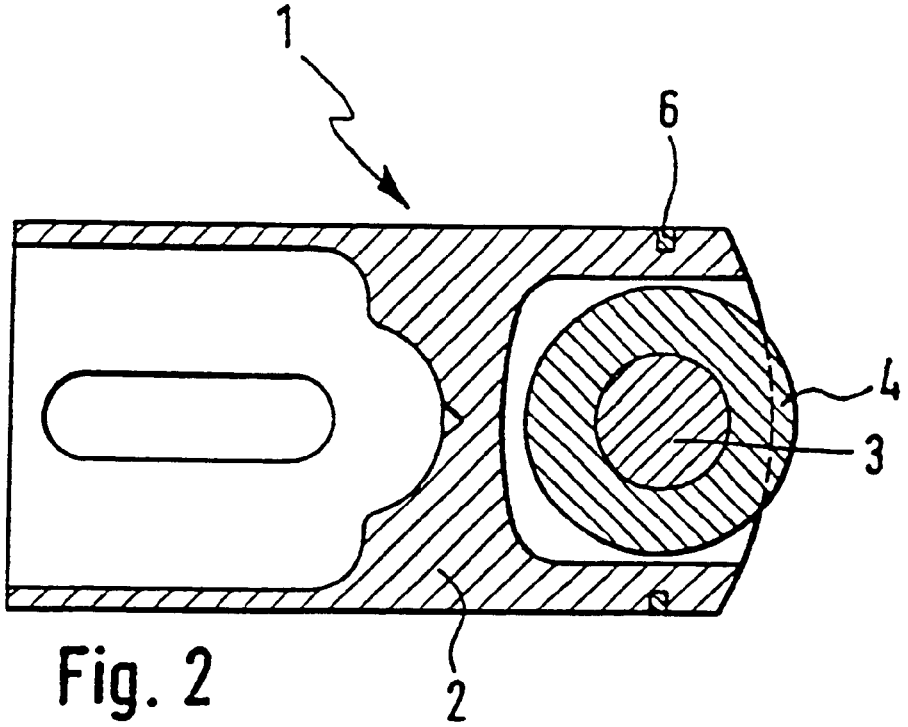

The invention is explained in greater detail in the following with the help of an exemplified embodiment. In the drawing, FIG. 1 shows a cross section through a roller tappet as defined by the invention, with a cut in the direction of the roller axle; and FIG. 2 shows a cross section of a roller tappet as defined by the invention, with a out transversely to the axle of the roller.

The roller tappet 1 comprises a basic body 2 and a roller 4. The basic body 2 comprises the bosses 5, in which the roller axle 3 is supported. A groove is cut into the basic body 2 at the level of the center of the boss, and a locking ring 6 is disposed in said groove. The roller axle 3 is supported in the bosses 5 and can freely rotate in said bosses. When the roller axle 3 is axially displaced in the bosses, it runs up against the radially inwardly disposed surface of the locking ring. The axial displacement of the roller axle 3 is consequently limited by the locking ring 6.

What is claimed is:

1. A roller tappet (1) comprising a basic body (2) and a roller (4) and a roller axle (3) rotatably supported on the roller (4), as well as a locking ring (6) for the roller axle (3), characterized by the following features:

the locking ring (6) is located in a groove in a radially externally disposed area of the basic body (2);

the locking ring (6) is disposed in a plane extending about perpendicular in relation to the longitudinal axis of the roller tappet (1);

the roller axle (3) is rotatably supported in the basic body (2);

the length of the roller axle (3) as well as the position and the inside diameter of the locking ring (6) are coordinated with each other in such a way that the locking ring prevents the roller axle (3) from exiting from the bosses (5).

2. The roller tappet (1) according to claim 1, characterized in that the locking ring (6) is located at the level of the center axis of the roller axle (3).

* * * * *